US012287090B2

(12) United States Patent
Farinha

(10) Patent No.: US 12,287,090 B2
(45) Date of Patent: Apr. 29, 2025

(54) INFRARED RADIATION EMITTER

(71) Applicant: SOLARONICS, Armentieres (FR)

(72) Inventor: James Farinha, Strazeele (FR)

( * ) Notice: Subject to any disclaimer, the term of this patent is extended or adjusted under 35 U.S.C. 154(b) by 425 days.

(21) Appl. No.: 17/776,308

(22) PCT Filed: Nov. 6, 2020

(86) PCT No.: PCT/EP2020/081356
§ 371 (c)(1),
(2) Date: May 12, 2022

(87) PCT Pub. No.: WO2021/094225
PCT Pub. Date: May 20, 2021

(65) Prior Publication Data

US 2022/0404014 A1 Dec. 22, 2022

(30) Foreign Application Priority Data

Nov. 15, 2019 (FR) ..... 1912779

(51) Int. Cl.
*F23D 14/14* (2006.01)

(52) U.S. Cl.
CPC ..... *F23D 14/145* (2013.01); *F23D 14/148* (2021.05); *F23D 2212/10* (2013.01)

(58) Field of Classification Search
CPC ..... F23D 2003/104; F23D 2003/105; F23D 2003/106
USPC ..... 431/326, 328, 329
See application file for complete search history.

(56) References Cited

U.S. PATENT DOCUMENTS 4,508,502 A * 4/1985 Itoh ..... F23D 14/145 126/92 R
4,569,657 A * 2/1986 Laspeyres ..... F24C 15/24 431/326
5,571,009 A * 11/1996 St.ang.lhane ..... F23D 14/145 126/41 R
2008/0241776 A1* 10/2008 Burtea ..... F23D 14/149 431/347
2011/0111356 A1* 5/2011 Claerbout ..... F23D 14/145 431/329

(Continued)

FOREIGN PATENT DOCUMENTS

JP 2002267115 A 9/2002
WO 2010003904 A1 1/2010

(Continued)

OTHER PUBLICATIONS

English language abstract of JP2000267115.

*Primary Examiner* — Ko-Wei Lin
(74) *Attorney, Agent, or Firm* — Cabinet Beau de Lomenie

(57) ABSTRACT

The disclosure relates to a gas-heated infrared radiation emitter comprising a burner plate, the burner plate serving as a combustion surface, and a radiating screen positioned on the combustion surface side of the burner plate. The radiating screen is formed by a mesh material or material with open pores, and has an inner face oriented towards the combustion surface side of the burner plate.

The inner surface of the screen comprises at least a first portion and a second portion offset from one another in relation to the combustion surface, such that the distance between the combustion surface and the first portion is less than the distance between the combustion surface and the second portion.

20 Claims, 3 Drawing Sheets

(56) References Cited

U.S. PATENT DOCUMENTS

| | | | | |
|---|---|---|---|---|
| 2013/0273485 | A1* | 10/2013 | Lenoir | F23D 14/145 126/92 AC |
| 2014/0116424 | A1 | 5/2014 | Satoh | |
| 2018/0066846 | A1* | 3/2018 | Karkow | F23D 14/02 |

FOREIGN PATENT DOCUMENTS

| | | | |
|---|---|---|---|
| WO | 20120084561 | A1 | 6/2012 |
| WO | 20170156440 | A1 | 9/2017 |

* cited by examiner

[Fig. 1]
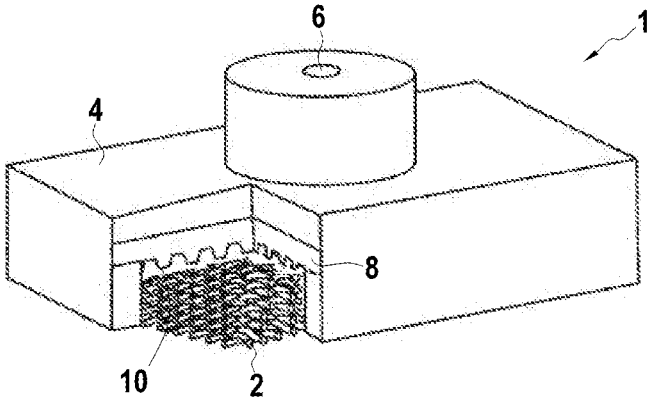
[Fig. 2]
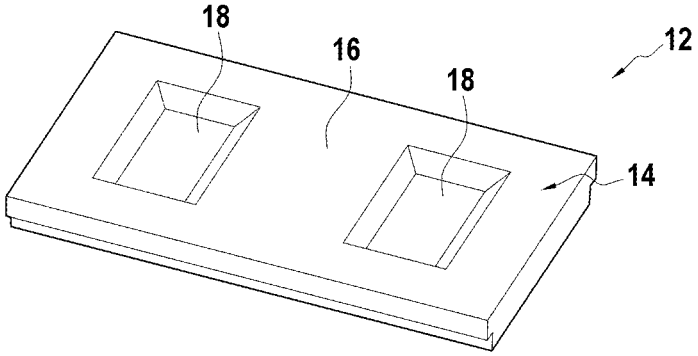
[Fig. 3]
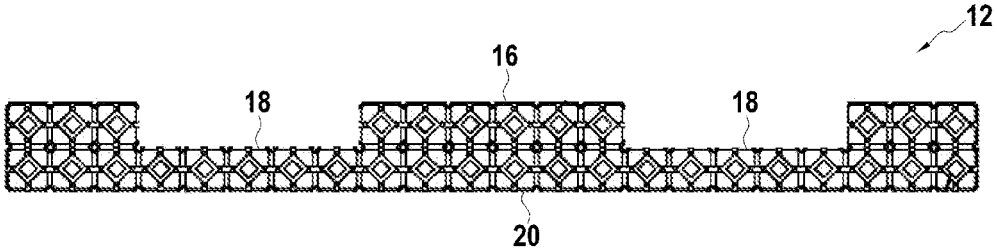

[Fig. 4]
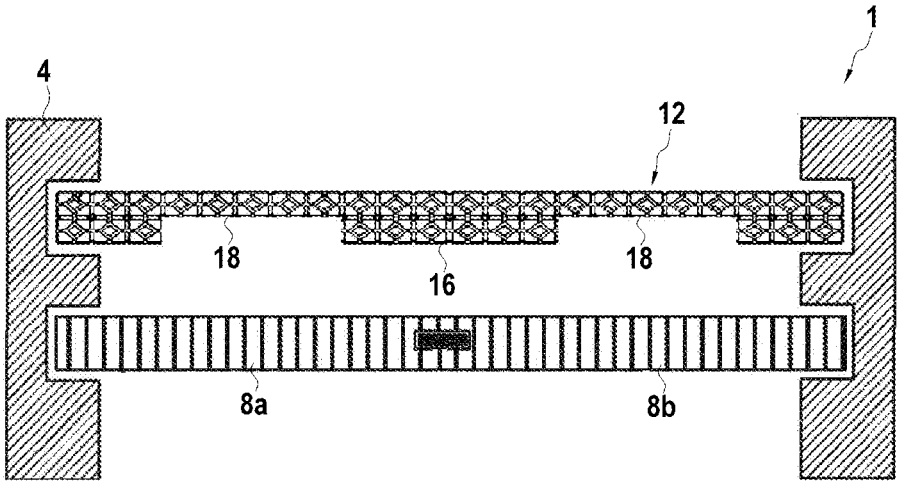
[Fig. 5]
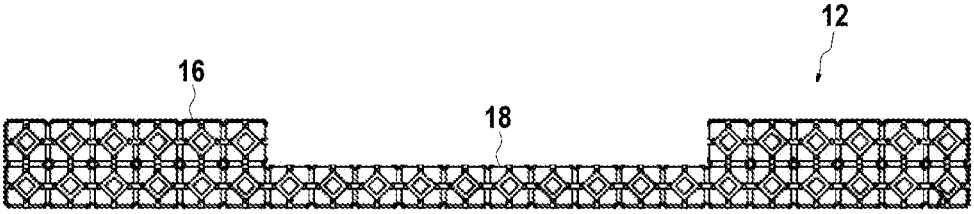

[Fig. 6]
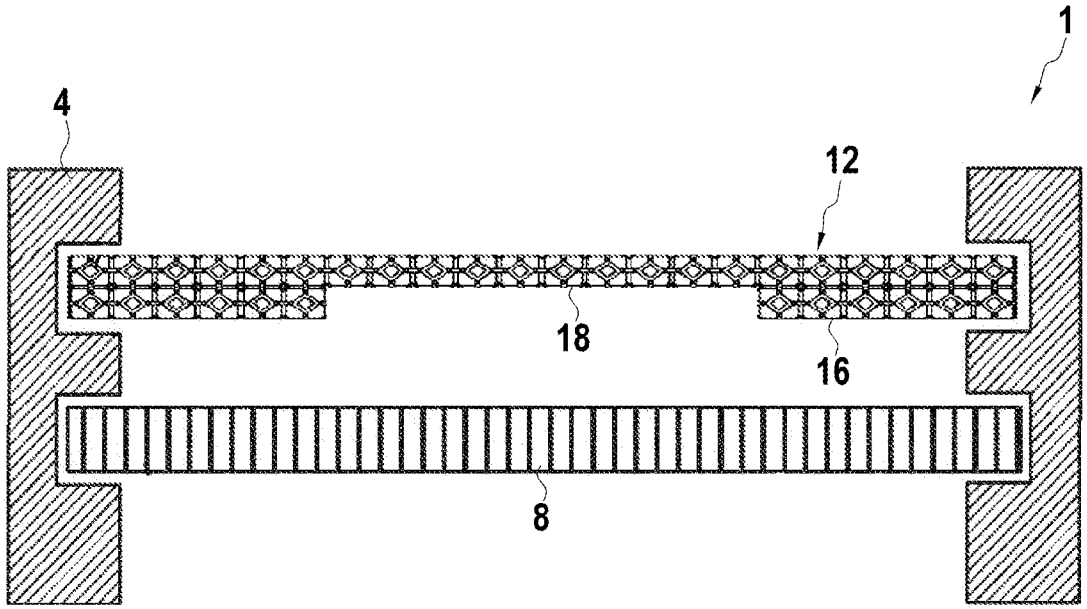
[Fig. 7]
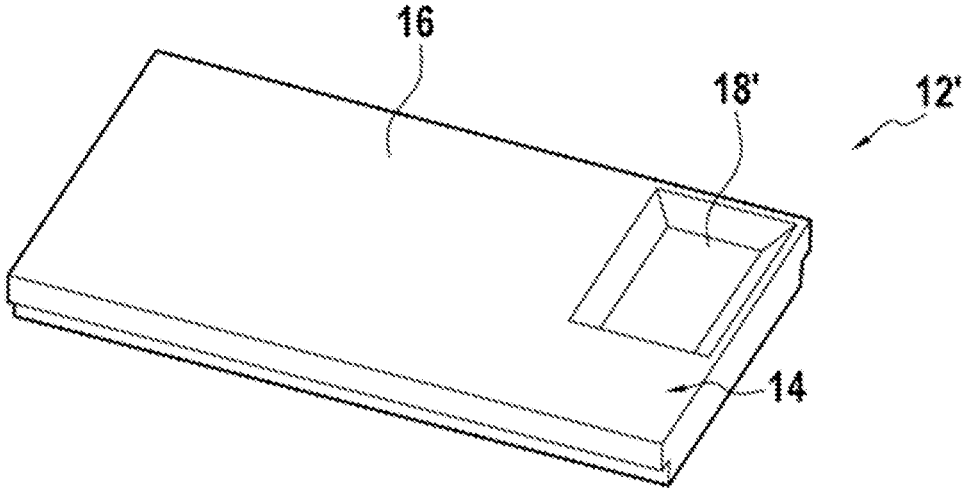

INFRARED RADIATION EMITTER

TECHNICAL FIELD

The present disclosure relates to the field of infrared radiation emitters, and in particular gas-heated emitters.

BACKGROUND

It is known to use a screen in gas-heated infrared radiation emitters. Such screens, positioned facing a burner plate, in general a perforated ceramic plate on which the gas is burnt, are intended to be heated by the combustion of the gas in order to emit infrared radiation, while allowing the circulation through them of the gases once burned.

Such screens can thus be formed by metal rods mounted in parallel, in a same plane and at a distance from one another. Alternatively, such screens can be formed by an assembly of metal wires that are criss-crossed or woven together.

Emitters with such screens have thus been known for a long time and have a stable and optimised operation enabling good efficiency to be obtained while limiting operating anomalies.

Screens also exist that are formed from foamed materials or materials with open pores.

It is also known to use a mesh material to form the screen of a gas-heated infrared radiation emitter. Such mesh materials can be designated as trellis-structured materials or as lattice-structured materials. In particular, such materials have a geometric spatial organisation. Hence, the structure of such materials corresponds to the repetition, in the three spatial directions, of a same geometric unit cell (mesh or cell), preferably in three dimensions. In particular, such materials can have a structure forming edges of unit cells (or meshes or cells) repeated in a three-dimensional network.

Such mesh materials have recently proved interesting for replacing traditional screens of infrared radiation emitters, in particular due to their efficiency. An infrared radiation emitter including such mesh material as a screen is described, in particular, in document WO 2017/156440.

However, the operation of such screens differs from conventional screens, such that it is not always possible to obtain stability and operating times of the emitter with a screen made of mesh material which are as high as those obtained with an emitter comprising a conventional screen. Thus, it has been observed that with such emitters with a screen made of mesh material, it is more difficult for the flame of the emitter to remain lit than with conventional screen emitters. In other words, it appeared that the flame could be caused to extinguish more easily or more frequently with a screen made of mesh material than with a conventional screen emitter.

SUMMARY

The present disclosure aims to solve the various technical problems stated above. The present disclosure thus aims to provide a gas-heated infrared radiation emitter, having an operating stability comparable to conventional emitters and a greater efficiency than that of conventional emitters. In particular, the present disclosure thus aims to provide a gas-heated infrared radiation emitter with a screen made of mesh material having improved operating stability, in particular during ignition.

Thus, according to one aspect, a gas-heated infrared radiation emitter is proposed comprising a burner plate, said burner plate serving as a combustion surface, and a radiating screen positioned on the combustion surface side of said burner plate. Said radiating screen is formed by a mesh material or material with open pores, and has an inner face oriented towards the combustion surface side of the burner plate. The inner surface of the screen comprises at least a first portion and a second portion offset from one another in relation to the combustion surface, such that the distance between the combustion surface and the first portion is less than the distance between the combustion surface and the second portion.

Indeed, the applicant has observed that the operating stability of the emitter with screen made of mesh material, in particular during ignition, increased when the distance between the burner plate and the screen was increased. Hence, by positioning the screen directly on the surface of the burner plate, as illustrated in document WO 2017/156440, the emitter can be difficult to ignite because the flame is caused to detach from the surface of the burner plate and to extinguish. However, moving the screen made of mesh material further away from the burner plate also leads to a reduction in the efficiency of the emitter, which can lead to similar performances to those of conventional screen emitters.

Hence, the emitter according to the present disclosure improves the operating stability of the emitter, in particular during ignition, due to the second portion of the inner surface of the screen which is located at a distance from the burner plate, while keeping a higher infrared radiation efficiency than that of conventional screen emitters, due to the first portion of the inner surface of the screen which remains in the immediate proximity of the burner plate. In particular, the applicant has noticed that it was sufficient to keep a distance between the screen made of mesh material and the burner plate, on only a portion of the inner surface of the screen, in order to maintain the flame on the burner plate. Indeed, the applicant has observed that the flame could, during the ignition of an emitter according to the present disclosure, detach, above all in the burner plate region located facing the first portion of the screen, but not in the burner plate regions facing the second portion of the screen, such that the flame still present in the burner plate region located facing the second portion of the screen could then reignite the flame on the remainder of the burner plate. Thus, through the emitter according to the disclosure, it becomes possible to obtain a region of the burner plate at which the flame remains attached and can reignite the flame over the remainder of the plate if it becomes extinguished. The burner plate region located facing the second portion of the screen also fulfils a pilot function for the emitter, enabling it to be fully reignited when it is partially extinguished.

Above all, the applicant has observed that the efficiency of the emitter could remain as high as that of an emitter as described in document WO 2017/156440, even with the second portion of the screen at a distance from the burner plate.

The difference in distance between the combustion surface and the first and second portions is preferably between 0.5 mm and 10 mm, preferably between 1 mm and 5 mm.

Such distances make it possible to both maintain the flame of the emitter, in particular during ignition, while having an increased efficiency.

The screen also preferably has an outer face opposite the inner face, the outer face being substantially planar and parallel to the two offset portions of the inner face, such that the thickness of the screen in the first portion is greater than the thickness of the screen in the second portion.

The inner face of the screen is preferably formed by the absence or by removal, in the second portion, of one or more mesh elements.

Since the screen made of mesh material has a structure resulting from the repetition, in the three spatial directions, of a same geometric unit cell, it is sufficient, in order to obtain the second portion of inner surface set back from the first portion of inner surface, to remove or withdraw one or more unit cells of the structure of the mesh material, for example a layer of several side unit cells, the layer having a thickness of between 1 and 5 unit cells.

The second portion of the screen is preferably arranged substantially facing the centre of the burner plate, for example facing the centre of a, preferably perforated, ceramic plate.

The second portion of the screen is intended to be located facing the hottest region of the burner plate. Indeed, the hottest regions of the burner plates may be caused to deteriorate first, so that by providing the second portion of screen facing such usually hotter burner plate regions, it becomes possible to limit the temperature and thus to increase the service life.

The emitter preferably comprises two burner plates mounted side-by-side, for example two ceramic plates, preferably perforated, and the screen includes two second portions located substantially facing the centre of each of the burner plates.

Here too, the two screen portions are provided facing the hottest regions, in other words facing the centre of each of the burner plates, in order to increase the emitter service life.

Alternatively, the second portion of the screen is arranged facing a peripheral part of the burner plate, or of each of the burner plates, for example on a peripheral part of the inner surface of the screen, such as a corner or along an edge of the inner surface of the screen.

The screen preferably forms edges of a plurality of geometric mesh elements assembled in a three-dimensional network.

The screen preferably forms a network of cubic mesh elements.

The screen preferably comprises silicon carbide, preferably infiltrated with silicon.

The silicon carbide makes it possible to obtain good strength at high temperature while keeping, unlike many ceramics, a high thermal conductivity. This makes it possible to obtain a temperature of the screen which is uniform, but also to avoid hot spots on the combustion support.

The first portion and the second portion are preferably substantially planar and parallel to one another.

The use of substantially planar portions makes it possible to better control the behaviour of the flame in each of said portions.

Alternatively, the first portion and/or the second portion are not planar.

Hence, the first portion and/or the second portion can be curved. For example, the inner surface of the screen can be curved so as to comprise at least a first portion and a second portion which are at different distances from the combustion surface.

The screen is preferably at a distance from the burner plate of, for example, at least 1 mm, and preferably at least 2 mm.

BRIEF DESCRIPTION OF THE FIGURES

FIG. 1 is a partial section, in perspective, of an infrared radiation emitter with a screen;

FIG. 2 is a schematic representation, in perspective, of a first aspect of the screen according to the disclosure for an infrared radiation emitter;

FIG. 3 is a schematic representation of a cross-section of the screen shown in FIG. 2, FIG. 4 is a schematic representation of a cross-section of an infrared radiation emitter equipped with the screen shown in FIG. 2, FIG. 5 is a schematic representation of a cross-section of a second aspect of the screen according to the disclosure;

FIG. 6 is a schematic representation of a cross-section of an infrared radiation emitter equipped with the screen shown in FIG. 5; and FIG. 7 is a schematic representation, in perspective, of a third aspect of the screen according to the disclosure for an infrared radiation emitter.

DETAILED DESCRIPTION

FIG. 1 shows a gas-heated infrared radiation emitter 1 including a screen 2, for example in the form of a metal grid or braided metal wires.

The emitter 1 includes a frame 4 with a supply inlet 6 for the gases to be burnt, and a burner plate 8 arranged facing the inner surface of the screen 2. The frame 4 and the burner plate 8 define an inner chamber into which the gases are conveyed entering via the supply inlet 6.

The burner plate 8 may be, for example, a perforated ceramic plate, the perforations of which are intended to allow gases present in the inner chamber of the emitter 1 to leave. On leaving the perforations, the gases are then burned on the outer surface 10, or combustion surface of the burner plate 8 when there is a flame, and then heat the screen 2 arranged facing the outer surface 10.

In particular, as illustrated in FIG. 1, the burner plate 8 may comprise a crenellated or ribbed outer surface 10. Hence, the burner plate 8 can have, on the outer surface 10, various levels of combustion surface, for example two. The outer surface 10 can, for example, comprise parallel ribs arranged obliquely over the entire surface of the burner plate 8.

Such burner plates 8 with a plurality of levels of combustion surface are described, in particular, in document WO 2010/003904.

FIG. 2 schematically shows the general shape of a screen according to the present disclosure. The screen is formed by a mesh material or material with open pores, and can comprise silicon carbide, preferably infiltrated with silicon. Hence, the screen can be formed by a material having a structure resulting from the repetition, in the three spatial directions, of a same geometric unit cell, as illustrated schematically in FIGS. 3 to 6, or else can be formed from a foamed material. A screen made of mesh material is described, in particular in document WO 2017/156440.

In both cases, in the rest of the description, the (imaginary) plane in which the end edges or end vertices of the meshed material are located is considered as the surface of the meshed material. Hence, the inner surface of the material will correspond to the plane in which the lower end edges or lower end vertices of the meshed material are located.

FIG. 2 therefore illustrates the geometric shape of a screen according to the present disclosure, by representing its contours by planes. More precisely, FIG. 2 illustrates a screen for which the surface intended to face the burner plate, in other words the inner surface, is represented.

As illustrated in FIG. 2, the screen 12 according to the present disclosure does not have a planar inner surface, but comprises by contrast an inner surface 14 with a main first portion 16 and at least one second portion 18 arranged set back with respect to the first portion 16. In the example illustrated in FIGS. 2 to 4, the screen 12 thus includes two second portions 18.

More precisely, the surface of the second portions 18 is offset with respect to the surface of the first portion 16, and is located below the surface of the first portion 16. The screen 12 thus has a geometric shape in which the inner surface 14 includes two hollows or recesses.

The second portions 18 can be planar, like the first portion 16, and can be parallel to the first portion 16.

FIG. 3 shows a schematic section through the screen 12 shown schematically in FIG. 2. As can be seen in FIG. 3, the screen 12 has a planar outer surface 20 which is opposite and parallel to the inner surface 14. The screen 12 thus has a thickness which is greater in the first portion 16 than in the second portions 18. Thus, the thickness difference of the screen 12 between the first portion 16 and the second portions 18 of the inner surface 14 can be between 0.5 mm and 10 mm, preferably between 1 mm and 5 mm.

Such a thickness difference can correspond to a multiple of the thickness of a geometric unit element of the mesh material. Hence, in order to produce the second portions 18, it may be sufficient to not form or two remove one or more layers of geometric unit elements of the mesh material, in order to obtain the second portions 18 with a surface that is planar and parallel to the first portion 16.

FIG. 4 represents an infrared radiation emitter 1 including a screen 12 as illustrated in FIGS. 2 and 3. The emitter 1 comprises, in particular, a frame 4 and a combustion surface. However, in the example illustrated in FIG. 4, the combustion surface of the emitter 1 is formed by two burner plates 8*a*, 8*b* arranged adjacently in order to form a continuous combustion surface.

As shown in FIG. 4, the screen 12 is arranged opposite the burner plates 8*a*, 8*b*, with the inner surface 14 facing the combustion surface. The screen 12 is not arranged directly on the burner plates 8*a*, 8*b*, but at a distance, for example the first portion 16 may be located at least 1 mm from the burner plates 8*a*, 8*b*, preferably at least 2 mm. Indeed, the proximity of the screen 12 may lead, in use, to "detachment" of the flame from the combustion surface and therefore to extinction of the emitter 1, in particular during ignition.

In order to limit such a problem, the screen 12 comprises the second portions 18 which, since they are arranged set back from the first portion 16, are even further away from the burner plates 8*a*, 8*b*. It therefore becomes easier and simpler to maintain the flame on the combustion surface at least in the second portions 18. Hence, when the flame is extinguished from the combustion surface located facing the first portion 16 of the screen, it can be reignited by the flame that is still present on the combustion surface located facing the second portion 18. The second portion 18 therefore makes it possible to maintain the operation of the emitter 1, in particular at ignition.

However, and in order to maintain a high efficiency of the emitter 1 which is, in the prior art, obtained with a screen made of mesh material positioned as close as possible to the combustion surface, the second portions 18 are provided with reduced dimensions. Hence, the total surface of the second portions 18 can be between 1% and 70% of the total surface area of the inner surface, preferably between 5% and 50% and more preferably between 10% and 30%.

Furthermore, the second portions 18 can be provided facing the hottest surface of the burner plates 8*a*, 8*b*, in other words facing the centre of the burner plates 8*a*, 8*b*. Indeed, the hottest surfaces of the burner plates are the surfaces which deteriorate most rapidly and which are most likely, over time, to prevent the proper operation of the emitter. Hence, by providing the second portions 18 facing the hottest regions of the burner plates 8*a*, 8*b*, it becomes possible to prolong the service life of the emitter.

Alternatively, the second portions 18 can be provided facing a peripheral part of the burner plates 8*a*, 8*b*, for example in a peripheral part of the inner surface 14 of the screen.

FIGS. 5 and 6 show a second aspect of the disclosure. In this second aspect, the emitter comprises only one burner plate 8. In this case, only one second portion 18 is provided in the screen 12 and is arranged facing the centre of the burner plate 8. Alternatively, the second portion 18 can be arranged facing a peripheral part of the burner plate 8, for example a peripheral part of the inner surface of the screen such as a corner or an edge of the inner surface of the screen.

FIG. 7 shows a third aspect of the disclosure. More precisely, FIG. 7 illustrates a screen for which the surface intended to face the burner plate, in other words the inner surface, is represented.

As illustrated in FIG. 7, the screen 12' according to the third aspect of the disclosure does not have a planar inner surface, but comprises by contrast an inner surface 14 with a main first portion 16 and at least one second portion 18' arranged set back with respect to the first portion 16. In the example illustrated in FIG. 7, the screen 12' thus includes a single second portion 18'. In particular, the second portion 18' is positioned on the periphery of the inner surface 14, in this case in a corner.

More precisely, the surface of the second portion 18' is offset with respect to the surface of the first portion 16, and is located below the surface of the first portion 16. The screen 12' thus has a geometric shape in which the inner surface 14 includes a hollow or a recess on the periphery. The screen 12' is shown with a single second portion 18' but can obviously comprise a plurality thereof, arranged at the corners and/or edges of the inner surface 14.

The second portion 18' can be planar, like the first portion 16, and can be parallel to the first portion 16.

Hence, through the specific shape of the screen according to the present disclosure, it becomes possible to combine the efficiency of mesh materials or materials with open pores while keeping the operating stability of conventional screen emitters. In particular, it becomes possible to keep a screen close to the burner plate, while guaranteeing the operating stability, in particular at ignition.

The invention claimed is:

1. A gas-heated infrared radiation emitter comprising:

a burner plate, the burner plate serving as a combustion surface, and a radiating screen positioned on a combustion surface side of the burner plate, the radiating screen being formed by a mesh material or material with open pores and having an inner surface oriented towards the combustion surface side of the burner plate, wherein the inner surface of the screen comprises at least a first portion and a second portion offset from one another in relation to the combustion surface, such that the distance between the combustion surface and the first portion is less than the distance between the combustion surface and the second portion, and wherein the screen also has an outer surface opposite the inner surface, the outer surface being substantially planar and parallel to the first and second portions of the inner surface such that the thickness of the screen in the first portion is greater than the thickness of the screen in the second portion.

2. The emitter of claim 1, wherein the difference in distance between the combustion surface and the first and second portions is between 0.5 mm and 10 mm.

3. The emitter of claim 1, wherein the inner surface of the screen is formed by the absence or by removal, in the second portion, of one or more mesh elements.

4. The emitter of claim 1, wherein the second portion of the screen is arranged substantially facing the centre of the burner plate.

5. The emitter of claim 1, wherein the second portion of the screen is arranged facing a peripheral part of the burner plate.

6. The emitter of claim 1, wherein the screen forms edges of a plurality of geometric mesh elements assembled in a three-dimensional network.

7. The emitter of claim 1, wherein the screen comprises silicon carbide.

8. The emitter of claim 1, wherein the first portion and the second portion are substantially planar and parallel to one another, or the first portion and/or the second portion is curved.

9. The emitter of claim 1, wherein the first portion of the screen is at a distance from the burner plate.

10. The emitter of claim 9, wherein the first portion of the screen is at a distance of at least 1 mm from the burner plate.

11. The emitter of claim 4, wherein the second portion of the screen is arranged substantially facing the centre of a ceramic plate.

12. The emitter of claim 11, wherein the second portion of the screen is arranged substantially facing the centre of a perforated ceramic plate.

13. The emitter of claim 7, wherein the second portion of the screen is arranged facing a peripheral part of the inner surface of the screen.

14. The emitter of claim 13, wherein the second portion of the screen is arranged facing a corner or along an edge of the inner surface of the screen.

15. The emitter of claim 7, wherein the screen further comprises silicon carbide infiltrated with silicon.

16. A gas-heated infrared radiation emitter comprising: a burner plate, the burner plate serving as a combustion surface, and a radiating screen positioned on a combustion surface side of the burner plate, the radiating screen having an inner surface oriented towards the combustion surface side of the burner plate, wherein the inner surface of the screen comprises at least a first portion and a second portion offset from one another in relation to the combustion surface, wherein the screen also has an outer surface opposite the inner surface, the outer surface being substantially planar and parallel to the first and second portions of the inner surface such that the thickness of the screen in the first portion is greater than the thickness of the screen in the second portion.

17. The emitter of claim 16, wherein the radiating screen is formed by a mesh material.

18. The emitter of claim 16, wherein the radiating screen is formed by a material with open pores.

19. The emitter of claim 16, wherein the distance between the combustion surface and the first portion is less than the distance between the combustion surface and the second portion.

20. A gas-heated infrared radiation emitter comprising: a burner plate, the burner plate serving as a combustion surface, and a radiating screen positioned on a combustion surface side of the burner plate, the radiating screen being formed by a mesh material or material with open pores and having an inner surface oriented towards the combustion surface side of the burner plate, wherein the inner surface of the screen comprises at least a first portion and a second portion offset from one another, wherein the screen also has an outer surface opposite the inner surface, the outer surface being substantially planar and parallel to the first and second portions of the inner surface such that the thickness of the screen in the first portion is greater than the thickness of the screen in the second portion.

* * * * *